US007365767B2

(12) United States Patent
Lee

(10) Patent No.: US 7,365,767 B2
(45) Date of Patent: Apr. 29, 2008

(54) APPARATUS FOR DRIVING PLASMA DISPLAY PANEL AND METHOD FOR DISPLAYING PICTURES ON PLASMA DISPLAY PANEL

(75) Inventor: Soo-Jin Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 546 days.

(21) Appl. No.: 11/050,262

(22) Filed: Feb. 2, 2005

(65) Prior Publication Data

US 2005/0184929 A1 Aug. 25, 2005

(30) Foreign Application Priority Data

Feb. 19, 2004 (KR) ..... 10-2004-0011123

(51) Int. Cl.
*G09G 3/28* (2006.01)

(52) U.S. Cl. ..... 348/68; 345/60; 345/63; 345/690; 345/692; 313/582; 313/585; 315/169.3; 315/169.4

(58) Field of Classification Search ..... 345/55, 345/60, 63, 68, 690, 692; 312/582, 585; 315/169.3, 169.4
See application file for complete search history.

(56) References Cited

U.S. PATENT DOCUMENTS 7,233,300 B2 * 6/2007 Kwon et al. ..... 345/63
7,242,374 B2 * 7/2007 Jeong et al. ..... 345/60
2003/0058476 A1 * 3/2003 Kwon et al. ..... 358/3.02
2003/0231147 A1 * 12/2003 Jeong et al. ..... 345/60
2004/0104907 A1 * 6/2004 Jeon ..... 345/204

FOREIGN PATENT DOCUMENTS

KR 2002-0014766 2/2002

OTHER PUBLICATIONS

Korean Patent Abstract, Publication No. 1020020014766 A, Published on Feb. 25, 2002, in the name of Iwamoto English Translation of KR 2002-0014766.

* cited by examiner

*Primary Examiner*—My-Chau T. Tran
(74) *Attorney, Agent, or Firm*—Christie, Parker & Hale, LLP

(57) ABSTRACT

An apparatus for driving a plasma display panel and a method for processing pictures of a plasma display panel. An input video signal is converted into sub-field data. It is determined whether address consumption power of the sub-field data is high. When the address consumption power is high, interlaced scanning is carried out. It is determined whether lines having sub-field data items identical or similar in a row direction exist using the sub-field data. The lines are sequentially scanned. Accordingly, the number of times of switching address electrodes is reduced and thus the address consumption power is decreased.

12 Claims, 7 Drawing Sheets

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |

| | | | | | | | |
|---|---|---|---|---|---|---|---|
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |

APPARATUS FOR DRIVING PLASMA DISPLAY PANEL AND METHOD FOR DISPLAYING PICTURES ON PLASMA DISPLAY PANEL

CROSS REFERENCE TO RELATED APPLICATION

This application claims priority to and the benefit of Korean Patent Application No. 10-2004-0011123 filed on Feb. 19, 2004 in the Korean Intellectual Property Office, the entire content of which is incorporated herein by reference.

BACKGROUND OF THE INVENTION (a) Field of the Invention

The present invention relates to an apparatus for driving a plasma display panel and a method for displaying pictures on the plasma display panel. More specifically, the present invention relates to a plasma display panel driving apparatus that controls address consumption power and a method for displaying pictures on the plasma display panel.

(b) Description of the Related Art

Recently, flat panel display devices including a liquid crystal display (LCD), a field emission display (FED), and a plasma display panel (PDP) have been actively developed. The plasma display panel has higher luminance and light-emission efficiency and wider viewing angle than other flat panel display devices. Accordingly, the plasma display panel is being spotlighted as a display device replacing a conventional cathode ray tube (CRT).

The plasma display panel is a flat panel display that displays characters or images using plasma generated by gas discharge. The plasma display panel is constructed in a manner such that tens through millions of pixels are arranged in a matrix form depending on its size. The plasma display panel is classified into DC and AC types of display panels based on the form of a voltage waveform applied to the plasma display panel and the structure of a discharge cell.

In the DC plasma display panel, electrodes are not insulated but are exposed in a discharge space so that current flows in the discharge space while a voltage is applied to the plasma display panel. Thus, the DC plasma display panel requires a resistor for restricting the current. In the AC plasma display panel, electrodes are covered with a dielectric layer and thus a capacitance component is naturally formed to restrict current. Furthermore, since the electrodes are protected from collision of ions when discharge occurs, the life of the AC plasma display panel is longer than the life of the DC plasma display panel.

FIG. 1 is a partial perspective view of a conventional AC plasma display panel. Referring to FIG. 1, a scan electrode 4 and a sustain electrode 5 are formed in a pair on a glass substrate 1 and covered with a dielectric layer 2 and a protective layer 3. The dielectric layer 2 is coated on the back side of the scan electrode 4 and sustain electrode 5 to control a discharge current when discharge occurs and to facilitate generation of wall charges. The protective layer 3 is formed of MgO and protects the plasma display panel from a strong electric field. The plasma display panel includes a plurality of address electrodes 8 formed on a glass substrate 6, and an insulating layer 7 covering the address electrodes 8. Ribs 9 are formed in parallel with the address electrodes 8 on portions of the insulating layer 7, which correspond to regions between the address electrodes 8. A fluorescent material 10 is coated on the surface of the insulating layer 7 and both sides of each rib 9. The glass substrates 1, 6 face each other having a discharge space 11 between them. The scan electrode 4 and sustain electrode 5 are located perpendicular to the address electrodes 8 between the glass substrates 1, 6. A discharge space disposed at the intersection of adjacent address electrodes 8 and the pair of the scan electrode 4 and sustain electrode 5 forms a discharge cell 12.

FIG. 2 illustrates the arrangement of electrodes of the plasma display panel. Referring to FIG. 2, the electrodes of the plasma display panel are arranged in a matrix form. Specifically, address electrodes A1 through Am are arranged in a column direction and n scan electrodes Y1 through Yn and n sustain electrodes X1 through Xn are arranged alternately in a row direction. A discharge cell 12 shown in FIG. 2 corresponds to the discharge cell 12 of FIG. 1.

The AC type plasma display panel is operated through a reset period, an address period, and a sustain period. The reset period initializes the state of each cell to smoothly carry out an addressing operation. During the address period, an address voltage is applied to lit cells (addressed cells) to accumulate wall charges in order to discriminate the lit cells from cells that are not lit in the plasma display panel. During the sustain period, a sustain pulse is applied to the panel to generate discharge for displaying images on addressed cells.

When the plasma display panel is operated in the reset period, address period, and sustain period, the discharge space functions as a capacitive load and thus capacitance exists in the panel. Accordingly, reactive power for charge injection, which generates a predetermined voltage for the capacitance, is needed in addition to power for address discharge in order to apply an addressing waveform to the plasma display panel. Here, a larger amount of address power is consumed when address electrodes are frequently switched.

As described above, the address power is generated by switching of the address electrodes, which will now be explained in more detail.

FIG. 3 shows video data in the case of full white. Referring to FIG. 3, in the case of full white, all video data is 1 and thus there is little variation in data of address electrodes and there is a small number of pulse switching operations. Furthermore, charging/discharging reactive power is small because power consumption is increased in proportion to the number of switching operations. A driving waveform in this case is shown in FIG. 4. As shown in FIG. 4, one column indicated by a bold line in FIG. 3 is switched only once in the full white mode.

FIG. 5 shows dot pattern video data. Referring to FIG. 5, data is continuously changed from 1 to 0 and from 0 to 1 to result in many switching operations. A driving waveform in this case is shown in FIG. 6. As shown in FIG. 6, data of address electrodes is frequently changed and pulse switching of the driving pulse frequently occurs to increase power consumption in the case of the dot pattern video data.

As described above, the larger a difference between pixels of a previous line and pixels of a current line, the larger the number of switching operations. Consequently, power consumption is increased.

SUMMARY OF THE INVENTION

In accordance with the present invention a plasma display panel driving apparatus for reducing address consumption power in response to an input video data pattern, and a method for displaying pictures on the plasma display panel, is provided.

In one aspect of the present invention, an apparatus for driving a plasma display panel includes a sub-field generator converting input video signal data into sub-field data and transmitting the sub-field data. A pattern detector determines whether address consumption power of the sub-field data transmitted from the sub-field generator is high and transmits a scan direction flag signal that allows interlaced scanning to be carried out when the address consumption power of the sub-field data is high. A memory controller rearranges the sub-field data transmitted from the sub-field generator such that an addressing operation corresponding to the scan direction flag signal is carried out when the scan direction flag signal is transmitted to the memory controller from the pattern detector. A scan/sustain driving controller generates a control signal that allows scan pulses to be applied corresponding to the scan direction flag signal when the scan direction flag signal is transmitted from the pattern detector to the scan/sustain driving controller.

In another aspect of the present invention, a method is provided for displaying pictures on a plasma display panel that divides an image of each frame displayed on the plasma display panel in response to an input video signal into a plurality of sub-fields and combines luminance weights of the plurality of sub-fields to display gray scales. The input video signal is converted into sub-field data and the sub-field data is transmitted. A determination is made as to whether address consumption power is high using the transmitted sub-field data. The sub-field data is rearranged such that interlaced scanning is carried out when the address consumption power is determined to be high. A scan pulse control signal is generated that allows interlaced scanning to be carried out when the address consumption power is determined to be high.

In still another aspect of the present invention, an apparatus for driving a plasma display panel includes a sub-field generator converting input video signal data into sub-field data and transmitting the sub-field data. A pattern detector determines whether lines having identical or similar sub-field data items exist using the sub-field data transmitted from the sub-field generator and transmits a scan direction flag signal such that the lines are sequentially scanned. A memory controller rearranges the sub-field data transmitted from the sub-field generator such that an addressing operation corresponding to the scan direction flag signal is carried out when the scan direction flag signal is transmitted to the memory controller from the pattern detector. A scan/sustain driving controller generates a control signal that allows scan pulses to be applied corresponding to the scan direction flag signal when the scan direction flag signal is transmitted from the pattern detector to the scan/sustain driving controller.

In yet another aspect of the present invention, a method is provided for displaying pictures on a plasma display panel that divides an image of each frame displayed on the plasma display panel in response to an input video signal, into a plurality of sub-fields and combines luminance weights of the sub-fields to display gray scales. The input video signal is converted into sub-field data and the sub-field data is transmitted. A determination is made as to whether lines having sub-field data items identical or similar in the row direction exist using the transmitted sub-field data. The sub-field data is rearranged such that the lines are sequentially scanned line by line when it is determined that the lines have sub-field data items identical or similar in the row direction exist. A scan pulse control signal is generated such that the lines having sub-field data items identical or similar in the row direction are sequentially scanned when it is determined that the lines have sub-field data items identical or similar in the row direction exists.

DETAILED DESCRIPTION

Figure 7:
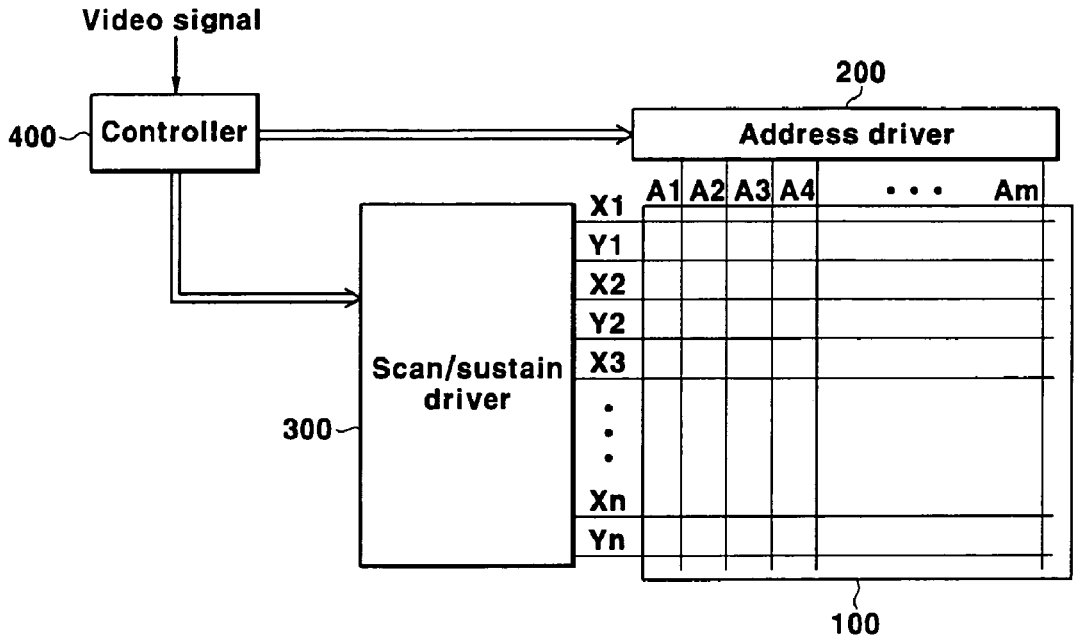
FIG. 7 is a simplified block diagram of a plasma display panel according to an embodiment of the present invention.

Referring now to FIG. 7, the plasma display panel includes a plasma panel 100, an address driver 200, a scan/sustain driver 300, and a controller 400. The plasma panel 100 includes a plurality of address electrodes A1 through Am arranged in a column direction, and a plurality of scan electrodes Y1 through Yn and sustain electrodes X1 through Xn arranged alternately in a row direction. The address driver 200 receives an address driving control signal from the controller 400 and applies a display data signal for selecting discharge cells to be displayed to the address electrodes A1 through Am. The scan/sustain driver 300 receives a control signal from the controller 400 and supplies a sustain voltage to the scan electrodes Y1 through Yn and sustain electrodes X1 through Xn alternately to generate a sustain discharge for the selected discharge cells. The controller 400 receives red, green, blue (RGB) video signals and a synchronous signal from an external device, divides a single frame into several sub-fields, and divides each sub-field into a reset period, an address period and a sustain discharge period (sustain period) to drive the plasma display panel. The controller 400 controls the number of sustain pulses included in the sustain period of each of the sub-fields of one frame and provides required control signals to the address driver 200 and scan/sustain driver 300.

The controller 400 according to exemplary embodiments of the present invention will now be explained in more detail with reference to FIGS. 8, 9, and 10.

Figure 8:
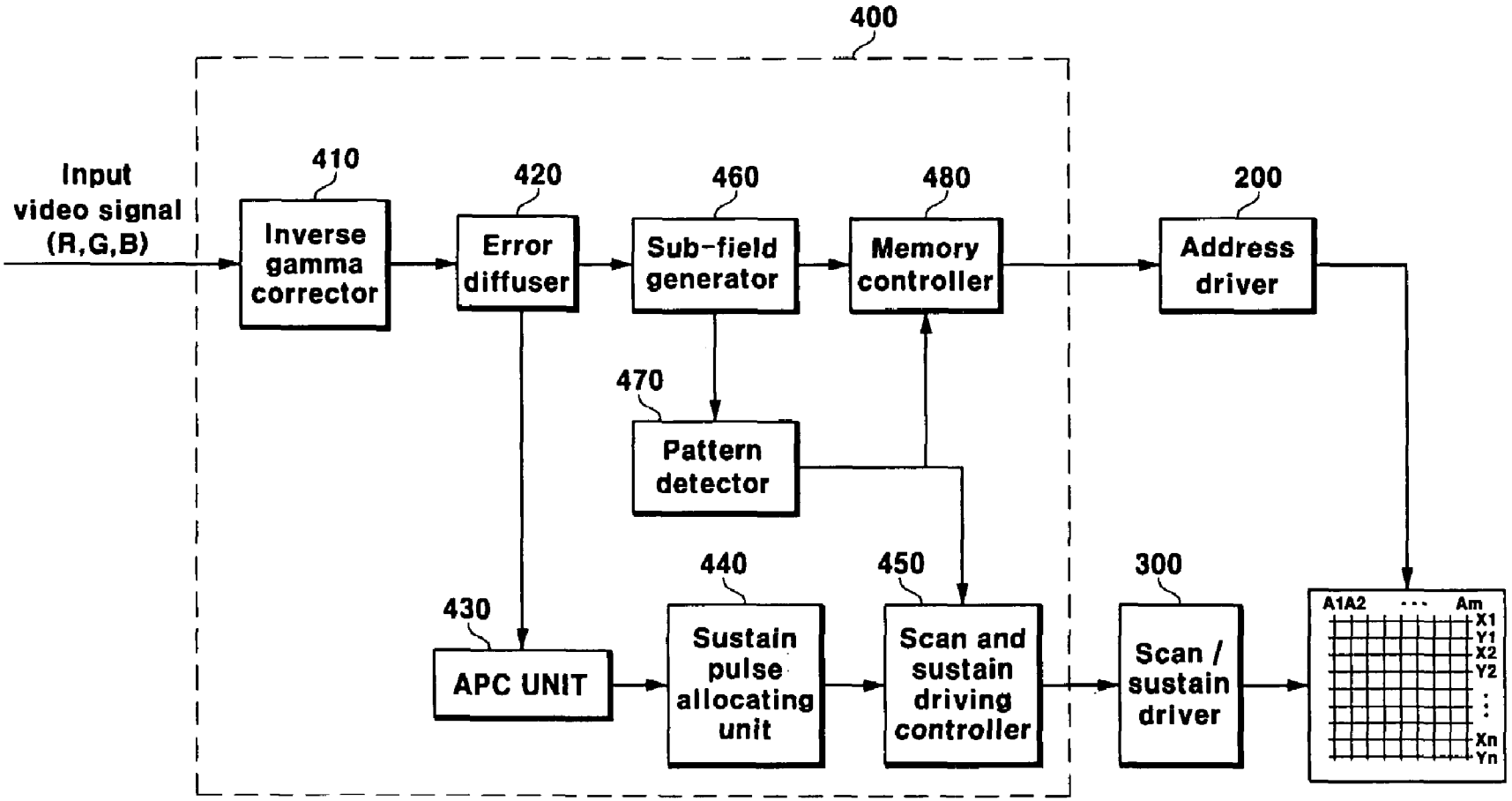
FIG. 8 is a block diagram of a controller of a plasma display panel for reducing address consumption power according to exemplary embodiments of the present invention.

Referring first to FIG. 8, the controller 400 includes an inverse gamma corrector 410, an error diffuser 420, an automatic power control (APC) unit 430, a sustain pulse allocating unit 440, a scan/sustain driving controller 450, a sub-field generator 460, a pattern detector 470, and a memory controller 480. The controller 400 of the plasma display panel is included in an apparatus for driving the plasma display panel.

The inverse gamma corrector 410 maps n-bit RGB video data currently input with an inverse gamma curve to correct the RGB video data into an m-bit video signal. In a typical plasma display panel, n is 8 and m is 10 or 12.

The video signal input to the inverse gamma corrector 410 is a digital signal. When an analog video signal is input to the plasma display panel, the analog video signal is required to be converted into a digital video signal using an analog/digital converter (not shown). The inverse gamma corrector 410 can include a look-up table (not shown) storing data corresponding to the inverse gamma curve used for mapping the input video signal or a logic circuit (not shown) for generating the data corresponding to the inverse gamma curve through logic operations.

The error diffuser 420 error-diffuses a lower (m−n)-bit image of the m-bit video signal inverse-gamma-corrected by the inverse gamma corrector 410 to surrounding pixels. Error diffusion is a method of dividing a lower bit image and diffusing the divided images to adjacent pixels to display the lower bit image, which is disclosed in detail in Korean Patent No. 2002-0014766.

The APC unit 430 detects a load rate using video data output from the error diffuser 420, calculates an APC level based on the detected load rate, and calculates the number of sustain pulses corresponding to the APC level.

The sustain pulse allocation unit 440 allocates the number of sustain pulses of each sub-field using the information about the number of sustain pulses transmitted from the APC unit 430.

The sub-field generator 460 generates sub-field data corresponding to the gradation of the video data output from the error diffuser 420. The sub-field data generated by the sub-field generator 460 is transmitted to the pattern detector 470 and memory controller 480.

Figures 5, 6:
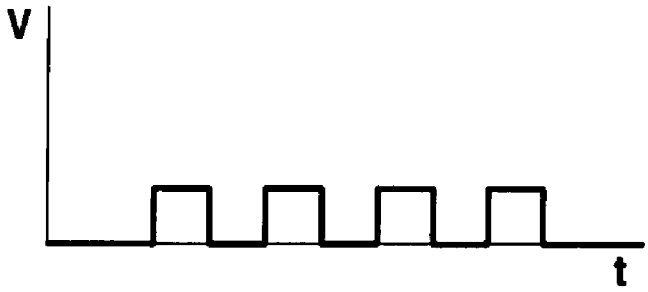
FIG.5 (Prior Art)
FIG.6 (Prior Art)
FIG. 5 shows dot pattern video data.
FIG. 6 shows a switching waveform of FIG. 5.

The pattern detector 470 determines whether the sub-field data transmitted from the sub-field generator 460 is a data pattern requiring large consumption power. The data pattern requiring large consumption power needs many address electrode switching operations, and it is generated when address data (that is, sub-field data) of a column (row) is different from address data of a row (column) adjacent to the column (row) as in the dot pattern of FIG. 5 or a line pattern (not shown).

Figure 1:
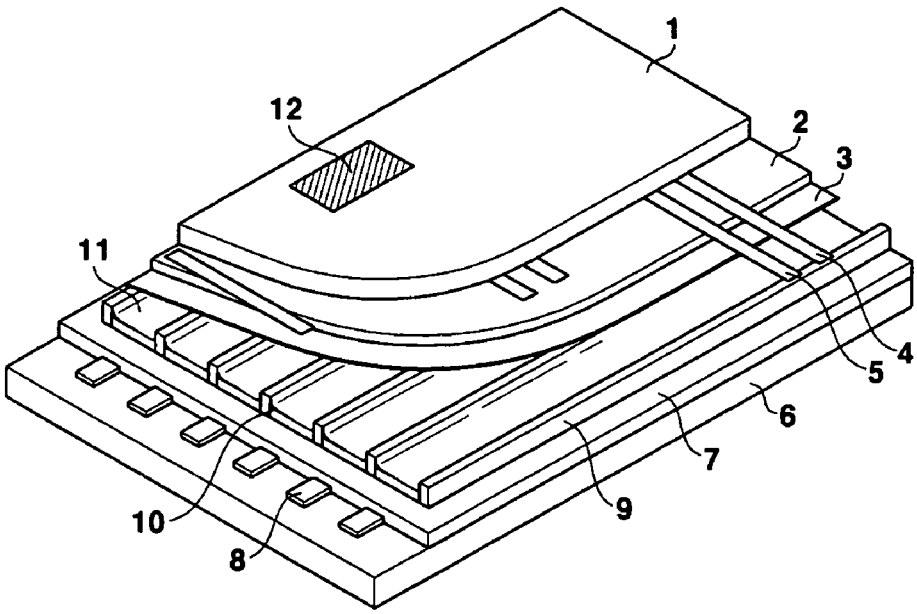
FIG.1 (Prior Art)
FIG. 1 is a partial perspective view of a conventional AC plasma display panel.
Figure 2:
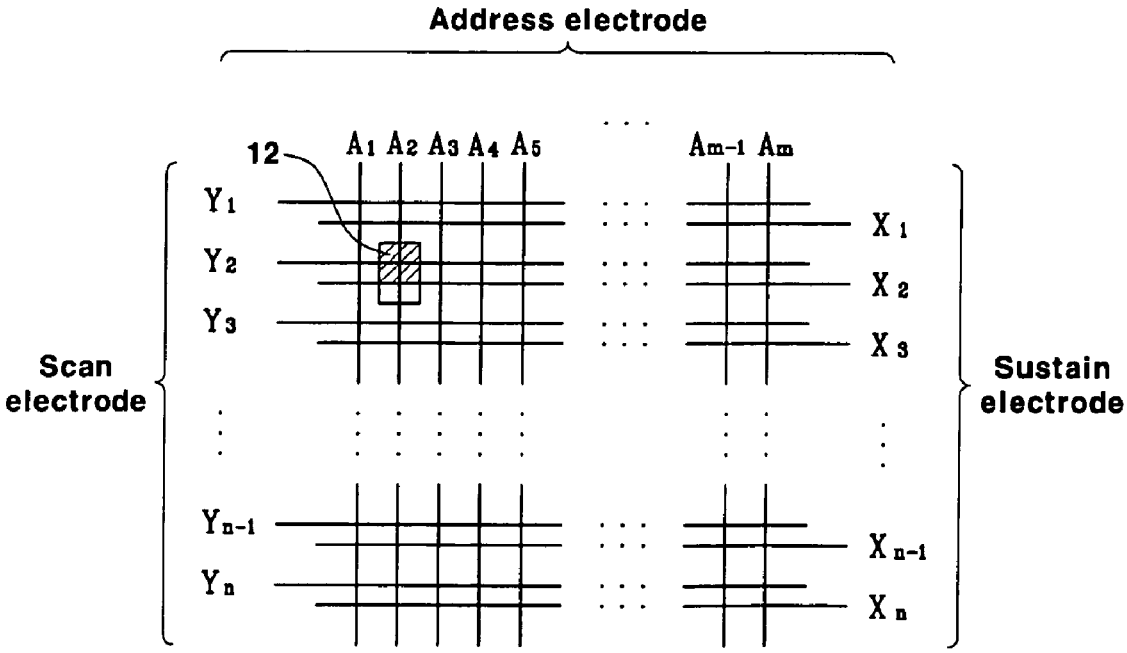
FIG.2 (Prior Art)
FIG. 2 shows the arrangement of electrodes of a plasma display panel.
Figures 3, 4:
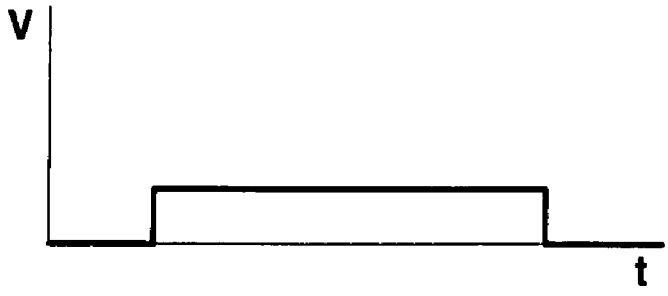
FIG.3 (Prior Art)
FIG.4 (Prior Art)
FIG. 3 shows video data in the case of full white.
FIG. 4 shows a switching waveform of FIG. 3.

A switching state is varied when one of two discharge cells adjacent to each other in the column direction (vertical direction in FIG. 2) is ON and the other discharge cell is OFF. Thus, the address consumption power can be calculated by the sum of differences between ON/OFF data items of two discharge cells adjacent to each other in the column direction, which is represented as follows.

$$AP = \sum_{i=1}^{n-1} \sum_{j=1}^{m} (|R_{ij} - R_{(i+1)j}| + |G_{ij} - G_{(i+1)j}| + |B_{ij} - B_{(i+1)j}|) \quad \text{[Equation 1]}$$

Here, $R_{ij}$, $G_{ij}$, and $B_{ij}$ are ON/OFF data items of R, G, and B discharge cells of a row i and a column j, respectively.

Typically, video signals are serially input in the column order. Thus, the pattern detector 470 includes a line memory (not shown) for storing a video signal of one column in order to calculate a difference between ON/OFF data items of two adjacent discharge cells. When ON/OFF data items for sub-fields with respect to the video signal of one column are input, the pattern detector 470 sequentially stores the ON/OFF data items and reads data of a previous column, stored in the line memory, to calculate a difference between ON/OFF data items of two adjacent discharge cells for each sub-field. Additionally, the pattern detector 470 calculates a difference between ON/OFF data items of two adjacent discharge cells for all of discharge cells and sums up the differences to obtain the address consumption power. Furthermore, the pattern detector 470 can calculate the difference between ON/OFF data items of two discharge cells by exclusive-ORing the ON/OFF data items.

The pattern detector 470 calculates the address consumption power using the method represented by Equation 1, compares the calculated address consumption power with a threshold, and outputs a scan direction flag signal to the memory controller 480 and scan/sustain driver when the address consumption power is larger than the threshold. Here, the threshold is previously stored through an experimental method. The pattern detector 470 compares the previously stored threshold with the calculated address consumption power and outputs the scan direction flag signal when the calculated value is larger than the threshold.

The scan direction flag signal means that an input video signal is interlaced-scanned (that is, odd-numbered lines are sequentially scanned first and then even-numbered lines are sequentially scanned) when the input video signal is a signal requiring large consumption power. The scan direction flag signal is transmitted to the memory controller 480 and scan/sustain driving controller 450.

The scan/sustain driving controller 450 generates a control signal corresponding to the number of sustain discharge pulses output from the sustain pulse allocating unit 440 and outputs the control signal to the scan/sustain driver 300. The scan/sustain driving controller 450 applies a scan pulse voltage to the scan electrodes Y1 through Yn during the address period of each sub-field. When the scan/sustain driving controller 450 receives the scan direction flag signal from the pattern detector 470, the scan/sustain driving controller 450 generates a control signal to supply scan pulses shown in FIG. 9 to the scan/sustain driver 300.

Figure 9:
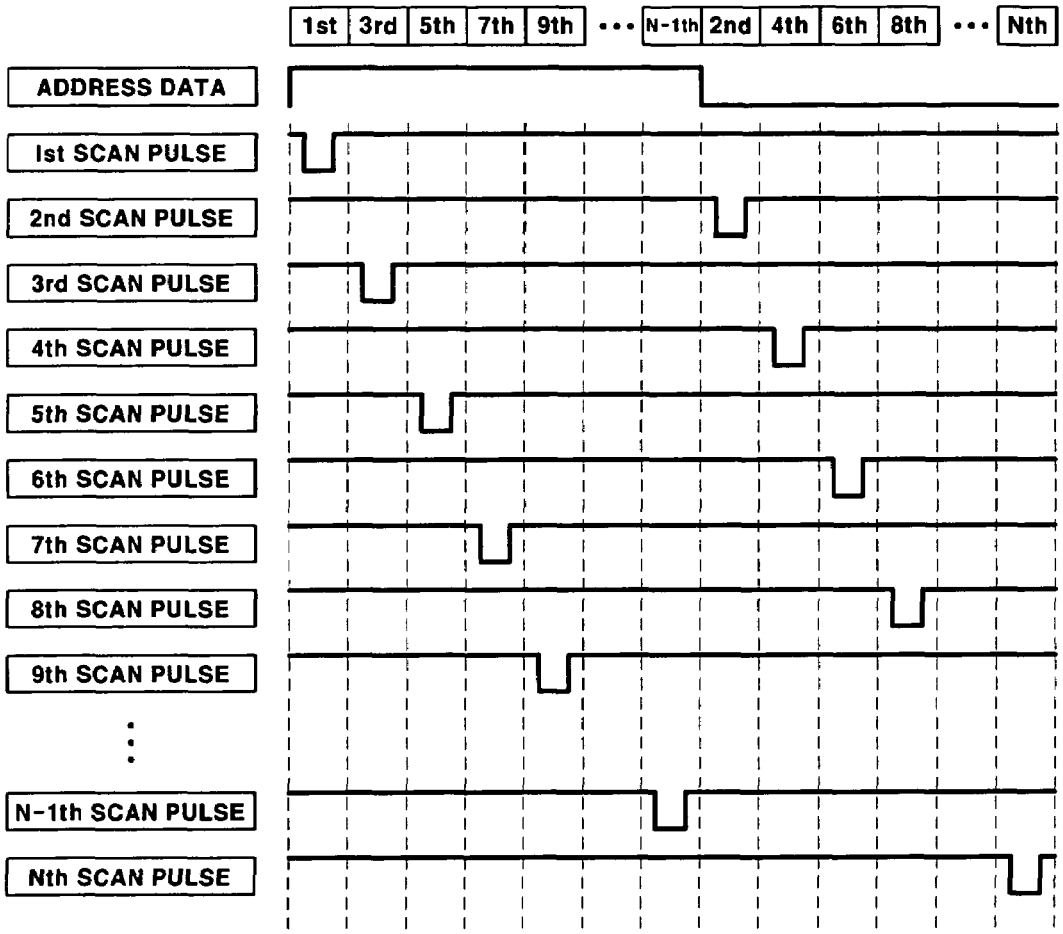
FIG. 9 shows an order of supplying scan pulses and an order of applying address data based on the scan pulse supply order when address consumption power is high according to a first embodiment of the present invention.

FIG. 9 shows an order of supplying scan pulses and an order of applying address data based on the scan pulse supply order when the address consumption power is high according to the first embodiment of the present invention. Referring to FIG. 9, in the case of high address consumption power, scan pulses are sequentially supplied to the first, third, fifth, . . . (N−1)th scan electrodes and then sequentially supplied to the second, fourth, sixth, . . . Nth scan electrodes. While the sustain pulse allocating unit 460 and scan/sustain driving controller 480 have been separately described in the embodiment of the present invention, they can be constructed in one block.

The memory controller 480 rearranges the sub-field data transmitted from the sub-field generator 460 into address data for driving the plasma display panel and generates an address control signal for controlling the address driver 200 to output the address control signal to the address driver 200. When the memory controller 480 receives the scan direction flag signal from the pattern detector 470, the memory controller 480 rearranges the sub-field data into address data in a scan direction. That is, the memory controller 480 rearranges the address (sub-field) data such that the first, third, fifth, (N−1)th address data items sequentially carry out addressing operations and then the second, fourth, sixth., Nth address data items sequentially execute addressing operations.

The address driver 200 receives the address driving control signal transmitted from the memory controller 480 and applies a display data signal for selecting discharge cells to be displayed to the address electrodes A1 through Am.

As described above, interlaced scanning is carried out by the controller of the plasma display panel, which reduces the address consumption power, so that identical or similar address data items are sequentially addressed to decrease the number of times of switching the address electrodes. This reduces the address consumption power.

While interlaced scanning is performed to reduce the address consumption power when the address consumption power is determined to be high in the above-described embodiment, several lines having identical or similar address data items in one direction can be grouped and sequentially scanned to reduce the number of times of switching the address electrodes. This will now be explained.

The construction of the controller of the plasma display panel for reducing the address consumption power according to a second embodiment of the present invention is identical to the construction of the controller 400 according to the first embodiment of the present invention except that the function of the pattern detector is different from that of the controller 400 according to the first embodiment.

Specifically, the controller 400 of the plasma display panel according to the second embodiment of the present invention includes the inverse gamma corrector 410, error diffuser 420, APC unit 430, sustain pulse allocating unit 440, scan/sustain driving controller 450, sub-field generator 460, pattern detector 470, and memory controller 480, as shown in FIG. 8.

The pattern detector 470 according to the second embodiment of the present invention determines whether a line (line in the row direction) having identical or similar sub-field (address) data items in the column direction exists. That is, the pattern detector 470 according to the second embodiment of the present invention determines whether there is a line having identical or similar sub-field data items in the column direction from the sub-field data transmitted from the sub-field generator 460. The pattern detector 470 includes a line memory (not shown) and stores sub-field data items of each line in the line memory. In addition, the pattern detector 470 detects a line having identical or similar sub-field data items in the column direction from the sub-field data items of each line stored in the line memory. A method of determining whether a line has identical or similar sub-field data items is similar to the method represented by Equation 1.

Specifically, the sum of differences between adjacent sub-field data Is items of a line is calculated, and if the differences are identical, it is determined that the line has identical sub-field data items. When the difference is smaller than a predetermined threshold, it is determined that the line has similar sub-field data items. Detailed explanation for the method is omitted because it is understood by those ordinary skilled in the art.

The pattern detector 470 of the controller according to the second embodiment of the present invention determines whether each line has identical or similar sub-field data items and transmits the scan direction flag signal that allows lines having identical or similar sub-field data items to be sequentially scanned to the memory controller 480 and scan/sustain driving controller 450.

The memory controller 480 according to the second embodiment of the present invention rearranges address data such that address data corresponding to the scan direction flag signal transmitted from the pattern detector 470 can be applied. Accordingly, the address data can be applied when lines having identical or similar sub-field data items are sequentially scanned.

The scan/sustain driving controller 450 according to the second embodiment of the present invention generates a control signal by which scanning corresponding to the scan direction flag signal transmitted from the pattern detector 470 can be carried out and transmits the control signal to the scan/sustain driver 300. That is, the scan/sustain driving controller 450 generates a control signal that allows scan pulses to be sequentially applied to the lines having identical or similar sub-field data items such that the lines are sequentially scanned.

Figure 10:
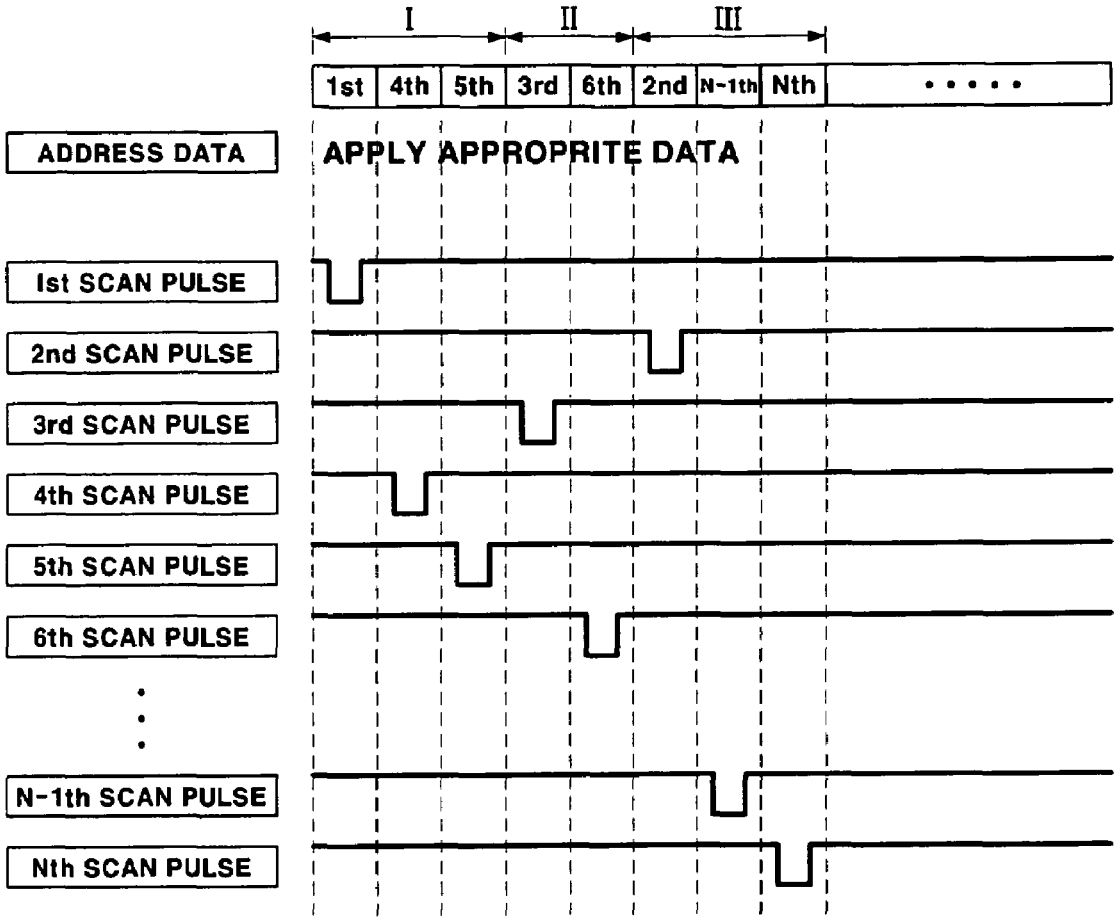
FIG. 10 shows an order of supplying scan pulses and an order of applying address data based on the scan pulse supply order according to a second embodiment of the present invention.

FIG. 10 shows an order of supplying scan pulses and an order of applying address data based on the scan pulse supply order according to the second embodiment of the present invention. FIG. 10 shows a scan pulse supply order and an address data application order based on the scan pulse supply order when sub-field data items of first, fourth, and fifth lines (column lines) are identical or similar in the row direction, sub-field data items of third and sixth lines are identical or similar in the row direction, and sub-field data items of second, (N−1)th, and Nth lines are identical or similar in the row direction.

That is, when the pattern detector 470 of the second embodiment determines that the sub-field data items of the first, fourth, and fifth lines (column lines) are identical or similar in the row direction, the sub-field data items of the third and sixth lines are identical or similar in the row direction, and the sub-field data items of the second, (N−1)th and Nth lines are identical or similar in the row direction, the pattern detector 470 transmits a scan flag signal that allows the first, fourth, and fifth lines to be scanned first, the third and fifth lines to be scanned next, and then the second, (N−1)th, and Nth lines to be scanned to the memory controller 480 and scan/sustain driving controller 450. Here, the scan/sustain driving controller 450 generates a scan pulse control signal by which scanning is carried out in the order shown in FIG. 10. The memory controller 480 rearranges address data such that address data is applied in the order of the first, fourth, fifth, third, sixth, second, (N−1)th, and Nth lines.

As described above, the controller of the plasma display panel according to the second embodiment of the present invention controls lines having similar address data items to be sequentially scanned to reduce the number of times of switching address electrodes. This decreases the address consumption power.

According to the present invention, interlaced scanning is carried out when the address consumption power is determined to be high to reduce the number of times of switching address electrodes and decrease the address consumption power. Furthermore, scan pulses are sequentially applied to lines having sub-field data items similar in the row direction to reduce the number of times of switching address electrodes and decrease the address consumption power.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for driving a plasma display panel comprising:

a sub-field generator adapted to convert input video signal data into sub-field data and to transmit the sub-field data;

a pattern detector adapted to determine whether address consumption power of the sub-field data transmitted from the sub-field generator is high and to transmit a scan direction flag signal that allows interlaced scanning to be carried out when the address consumption power of the sub-field data is high;

a memory controller adapted to rearrange the sub-field data transmitted from the sub-field generator such that an addressing operation corresponding to the scan direction flag signal is carried out when the scan direction flag signal is transmitted to the memory controller from the pattern detector; and a scan/sustain driving controller adapted to generate a control signal that allows scan pulses to be applied corresponding to the scan direction flag signal when the scan direction flag signal is transmitted from the pattern detector to the scan/sustain driving controller.

2. The apparatus as claimed in claim 1, wherein the pattern detector determines whether the address consumption power is high using a sum of differences between sub-field data items of vertically adjacent lines of the same row.

3. The apparatus as claimed in claim 1, wherein the pattern detector includes a line memory for storing the sub-field data transmitted from the sub-field generator line by line.

4. The apparatus as claimed in claim 2, wherein the pattern detector includes a line memory for storing the sub-field data transmitted from the sub-field generator line by line.

5. A method for displaying pictures on a plasma display panel that divides an image of each frame displayed on the plasma display panel in response to an input video signal into a plurality of sub-fields and combines luminance weights of the plurality of sub-fields to display gray scales, comprising:

converting the input video signal into sub-field data and transmitting the sub-field data;

determining whether address consumption power is high using transmitted sub-field data;

rearranging the sub-field data such that interlaced scanning is carried out when the address consumption power is determined to be high; and generating a scan pulse control signal that allows interlaced scanning to be carried out when the address consumption power is determined to be high.

6. The method as claimed in claim 5, wherein determining whether the address consumption power is high includes using a sum of differences between sub-field data items of vertically adjacent lines of the same row.

7. The method as claimed in claim 5, further comprising applying a scan pulse voltage and address voltage such that an address operation corresponding to the rearranged sub-field data and scan pulse control signal is carried out.

8. The method as claimed in claim 6, further comprising applying a scan pulse voltage and address voltage such that an address operation corresponding to the rearranged sub-field data and scan pulse control signal is carried out.

9. An apparatus for driving a plasma display panel, comprising:

a sub-field generator adapted to convert input video signal data into sub-field data and to transmit the sub-field data;

a pattern detector adapted to determine whether lines having identical or similar sub-field data items exist using the sub-field data transmitted from the sub-field generator and to transmit a scan direction flag signal such that the lines are sequentially scanned;

a memory controller adapted to rearrange the sub-field data transmitted from the sub-field generator such that an addressing operation corresponding to the scan direction flag signal is carried out when the scan direction flag signal is transmitted to the memory controller from the pattern detector; and a scan/sustain driving controller adapted to generate a control signal that allows scan pulses to be applied corresponding to the scan direction flag signal when the scan direction flag signal is transmitted from the pattern detector to the scan/sustain driving controller.

10. The apparatus as claimed in claim 9, wherein the pattern detector determines whether the lines having identical or similar sub-field data items exist using the sum of difference between sub-field data items of lines.

11. A method for displaying pictures on a plasma display panel that divides an image of each frame displayed on the plasma display panel in response to an input video signal into a plurality of sub-fields and combines luminance weights of the sub-fields to display gray scales, comprising:

converting the input video signal into sub-field data and transmitting the sub-field data;

determining whether lines having sub-field data items identical or similar in a row direction exist using transmitted sub-field data;

rearranging the sub-field data such that the lines are sequentially scanned line by line when it is determined that the lines have sub-field data items identical or similar in the row direction exist; and generating a scan pulse control signal such that the lines having sub-field data items identical or similar in the row direction are sequentially scanned when it is determined that the lines have sub-field data items identical or similar in the row direction exists.

12. The method as claimed in claim 11, further comprising applying a scan pulse voltage and address voltage such that an address operation corresponding to the rearranged sub-field data and scan pulse control signal is carried out.

* * * * *